US007730566B2

(12) United States Patent
Flick et al.

(10) Patent No.: US 7,730,566 B2
(45) Date of Patent: Jun. 8, 2010

(54) MULTI-WALLED GELASTIC MATERIAL

(75) Inventors: Roland E. Flick, Elma, NY (US); Joel T. Jusiak, Holland, NY (US)

(73) Assignee: Gaymar Industries, Inc., Orchard Park, NY (US)

( * ) Notice: Subject to any disclaimer, the term of this patent is extended or adjusted under 35 U.S.C. 154(b) by 536 days.

(21) Appl. No.: 11/602,099

(22) Filed: Nov. 20, 2006

(65) Prior Publication Data

US 2008/0115286 A1 May 22, 2008

(51) Int. Cl.
*A47C 16/00* (2006.01)

(52) U.S. Cl. ..... 5/655.5; 5/644; 5/654; 5/909; 267/153; 297/452.27

(58) Field of Classification Search ..... 5/644, 5/654, 653, 655.5, 909, 652.1, 724, 727, 5/729, 730; 267/81, 151–153; 297/452.27; 428/138

See application file for complete search history.

(56) References Cited

U.S. PATENT DOCUMENTS 5,336,708 A 8/1994 Chen
5,749,111 A * 5/1998 Pearce ..... 5/652
7,076,822 B2 7/2006 Pearce
2003/0110567 A1 6/2003 Kawamura
2005/0223667 A1 10/2005 McCann

FOREIGN PATENT DOCUMENTS

EP 1421878 5/2004

OTHER PUBLICATIONS

European search report for corresponding European application—8 pages.

* cited by examiner

*Primary Examiner*—Peter M Cuomo
*Assistant Examiner*—Nicholas Polito
(74) *Attorney, Agent, or Firm*—Roach Brown McCarthy & Gruber, P.C.; Kevin D. McCarthy

(57) ABSTRACT

The present invention is directed to a gelastic cushion. The gelastic cushion is made from a conventional gelastic composition. The gelastic cushion has a structure having a first wall that defines an opening area and buckles when a force is applied to the first wall. When the first wall buckles a predetermined amount, a second wall, interconnected to the first wall, also buckles. The second wall decreases the chance that the first wall bottoms out. Bottoming out increases the pressure on the patient (a.k.a., the force) overlying the gelastic cushion. That increased pressure is undesirable.

18 Claims, 18 Drawing Sheets

MULTI-WALLED GELASTIC MATERIAL

FIELD OF THE INVENTION

The present invention is directed to a gelastic material.

BACKGROUND OF THE INVENTION

Gelastic Material

In U.S. Pat. No. 7,076,822; Pearce discloses that gelastic materials "are low durometer thermoplastic elastomeric compounds and viscoelastomeric compounds which include . . . an elastomeric block copolymer component and a plasticizer component. [A plasticizer is a hydrocarbon molecule which associates with the material into which they are incorporated. Additives can also be inserted into the formulation to obtain specific qualities.]

The elastomer component of the example gel material includes a triblock polymer of the general configuration A-B-A, wherein the A represents a crystalline polymer such as a mono alkenylarene polymer, including but not limited to polystyrene and functionalized polystyrene, and the B is an elastomenc polymer such as polyethylene, polybutylene, poly(ethylene/butylene), hydrogenated poly(isoprene), hydrogenated poly(butadiene), hydrogenated poly(isoprene+butadiene), poly(ethylene/propylene) or hydrogenated poly (ethylene/butylene+ethylene/propylene), or others. The A components of the material link to each other to provide strength, while the B components provide elasticity. Polymers of greater molecular weight are achieved by combining many of the A components in the A portions of each A-B-A structure and combining many of the B components in the B portion of the A-B-A structure, along with the networking of the A-B-A molecules into large polymer networks.

The elastomeric B portion of the example A-B-A polymers has an exceptional affinity for most plasticizing agents, including but not limited to several types of oils, resins, and others. When the network of A-B-A molecules is denatured, plasticizers which have an affinity for the B block can readily associate: with the B blocks. Upon renaturation of the network of A-B-A molecules, the plasticizer remains highly associated with the B portions, reducing or even eliminating plasticizer bleed from the material when compared with similar materials in the prior art, even at very high oil:elastomer ratios . . . .

The elastomer used in the example gel cushioning medium is preferably an ultra high molecular weight polystyrene-hydrogenated poly(isoprene+butadiene)-polystyrene, such as those sold under the brand names SEPTON 4045, SEPTON 4055 and SEPTON 4077 by Kuraray, an ultra high molecular weight polystyrene-hydrogenated polyisoprene-polystyrene such as the elastomers made by Kuraray and sold as SEPTON 2005 and SEPTON 2006, or an ultra high molecular weight polystyrene-hydrogenated polybutadiene-polystyrene, such as that sold as SEPTON 8006 by Kuraray. High to very high molecular weight polystyrene-hydrogenated poly(isoprene+butadiene)-polystyrene elastomers, such as that sold under the trade name SEPTON 4033 by Kuraray, are also useful in some formulations of the example gel material because they are easier to process than the example ultra high molecular weight elastomers due to their effect on the melt viscosity of the material."

Other examples of gelastic material compositions are disclosed in other patents that identify Pearce as an inventor or Chen as an inventor (for example U.S. Pat. No. 5,336,708). The present invention is not directed toward the type of gelastic material being used. Instead the present invention is directed to how the gelastic material is formed and the desired shape of the material.

Cushion Material

Pearce also discloses the gelastic material can be formed into a cushion. The cushion may be used with many types of products, including furniture such as office chairs, "sofas, love seats, kitchen chairs, mattresses, lawn furniture, automobile seats, theatre seats, padding found beneath carpet, padded walls for isolation rooms, padding for exercise equipment, wheelchair cushions, bed mattresses, and others."

Conventional Gelastic Cushion Structure

Pearce further states, "the cushioning element . . . includes gel cushioning media formed generally into a rectangle with four sides, a top and a bottom, with the top and bottom being oriented toward the top and bottom of the page, respectively. The cushioning element has within its structure a plurality of hollow columns . . . . As depicted, the hollow columns . . . contain only air. The hollow columns . . . are open to the atmosphere and therefore readily permit air circulation through them, through the cover . . . fabric, and to the cushioned object. The columns . . . have column walls . . . which in the embodiment depicted are hexagonal in configuration. The total volume of the cushioning element may be occupied by not more than about 50% gel cushioning media, and that the rest of the volume of the cushioning element will be gas or air. The total volume of the cushioning element may be occupied by as little as about 9% cushioning media, and the rest of the volume of the cushion will be gas or air. This yields a lightweight cushion with a low overall rate of thermal transfer and a [low] overall thermal mass. It is not necessary that this percentage be complied with in every instance."

When a patient is positioned on the gelastic material, the patient's protuberances (the hip(s), shoulder(s), arm(s), buttock(s), shoulder blade(s), knee(s), and/or heel(s)) cause the column walls positioned below the patient's protuberances to buckle. Those buckled column walls are not supposed to collapse or fail because then the patient would bottom out on the underlying surface. Instead, the column walls positioned below and receiving the weight of the patient's protuberances buckle (bending and/or compressing) to redistribute and/or lessen the load of those buckled column walls to other column walls of the gelastic material. In other words, buckling the column (or side) walls permit the cushioning element to conform to the shape of the cushioned object while (a) evenly distributing a supporting force across the contact area of the cushioned object, (b) avoiding pressure peaks against the user, and (c) decreasing the chance of the patient bottoming out. Bottoming out, however, sometimes occurs.

Stepped Column Gelastic Cushion Embodiment

To address the occasional bottoming out problem, it is our understanding that Pearce disclosed numerous cushion embodiments to solve that problem. One cushion embodiment "depicts a cross section of a cushioning element using alternating stepped columns. The cushioning element . . . has a plurality of columns . . . each having a longitudinal axis . . . , a column top . . . and a column bottom . . . . The column top . . . and column bottom . . . are open . . . , and the column interior or column passage . . . is unrestricted to permit air flow through the column . . . . The column . . . depicted has side walls . . . , each of which has three distinct steps . . . . The columns are arranged so that the internal taper of a column due to the step on its walls is opposite to the taper of the next adjacent column. This type of cushioning element could be made using a mold."

A problem with Pearce's stepped column embodiment is that the side walls do not uniformly buckle due to the varied thicknesses. As previously stated, buckling the column (or side) walls permit the cushioning element to conform to the shape of the cushioned object while evenly distributing a supporting force across the contact area of the cushioned object and avoiding pressure peaks against the user. Buckling is difficult when the side walls are thick and tapered as disclosed in Pearce's stepped column gelastic material embodiment. The thicker portion of the walls do not decrease pressure peaks, instead the thicker portion of the walls maintain or increase the pressure peaks. Those pressure peaks are to be avoided and are not in Pearce's stepped column gelastic material embodiment.

Firmness Protrusion

Pearce also discloses a gelastic cushion having a firmness protrusion device positioned within the column walls to prevent the column walls from over-buckling (failing or collapsing so the patient bottoms out). In particular, Pearce wrote, "The cushioning element . . . has cushioning medium . . . formed into column walls . . . . The column walls . . . form a column interior . . . . The column . . . has an open column top . . . and a closed column bottom . . . . In the embodiment depicted, the column . . . has a firmness protrusion . . . protruding into the column interior . . . from the column bottom . . . . The firmness protrusion . . . depicted is wedge or cone shaped, but a firmness protrusion could be of an desired shape, such as cylindrical, square, or otherwise in cross section along its longitudinal axis. The purpose of the firmness protrusion . . . is to provide additional support within a buckled column for the portion of a cushioned object that is causing the buckling. When a column of this embodiment buckles, the cushioning element will readily yield until the cushioned object begins to compress the firmness protrusion. At that point, further movement of the cushioned object into the cushion is slowed, as the cushioning medium of the firmness support needs to be compressed or the firmness support itself needs to be caused to buckle in order to achieve further movement of the cushioned object into the cushioning medium." The firmness protrusion is a block of material designed to inhibit further buckling of the column walls. At best due to its shape and function, the firmness protrusion does not buckle.

Stacked Gelastic Cushion Embodiment

Another cushion embodiment is a stacked gelastic cushion embodiment which was claimed in U.S. Pat. No. 7,076,822. The stacked cushion embodiment as claimed has the following limitations:

"(a) a first cushioning element and a second cushioning element stacked together in sequence to form a stacked cushion, (b) said stacked cushion having a stacked cushion bottom;

(c) said first cushioning element including (i) a quantity of first gel cushioning medium formed to have a first cushioning element top, a first cushioning element bottom, and a first outer periphery, said first gel cushioning medium being compressible so that it will deform under the compressive force of a cushioned object;

(ii) wherein said first gel cushioning media is flexible and resilient, having shape memory and being substantially solid and non-flowable at temperatures below 130° Fahrenheit;

(iii) a plurality of first hollow columns formed in said first gel cushioning medium, each of said first hollow columns having a first longitudinal axis along its length, each of said first hollow columns having a first column wall which defines a first hollow column interior, and each of said first hollow columns having two ends;

(iv) wherein each of said first column ends is positioned at two different points of said first longitudinal axis;

(v) wherein at least one of said first hollow columns of said first cushioning element is positioned within said first gel cushioning medium such that said first longitudinal axis is positioned generally parallel to the direction of a compressive force exerted on the stacked cushion by a cushioned object in contact with the stacked cushion;

[sic] (c) wherein the stacked cushion is adapted to have a cushioned object placed in contact with said stacked cushion top; and (d) wherein at least one of said first column walls of said first cushioning element is capable of buckling beneath a protuberance that is located on the cushioned object."

The stacked gelastic cushion embodiment is unstable unless the first cushioning element and the second cushioning element are secured to each other. Securing the two cushions together can be accomplished by adhesives and/or straps (rubber, cloth or equivalent) without fasteners (like a rubber band) or with fasteners (i.e., hook and loop, buckles and/or tying). The present invention avoids those securing devices because that increases the potential pressure peaks applied to the patient.

How to Prevent Gelastic Cushion from Moving

The gelastic cushion is known to move in response to patient's applying a force to the gelastic cushion. To decrease that problem, the users of gelastic cushion have heated a non-woven material on the bottom surface of the gelastic cushion. That non-woven can cover the entire bottom surface or just a particular area including and not limited to being near and at the perimeter of the bottom surface.

The non-woven can also extend beyond the bottom surface's perimeter. The non-woven material that extends beyond the bottom surface's perimeter is then normally attached to another part of the cushion and that attachment decreases the chances that the gelastic cushion will move when the patient applies a force to it. This embodiment is very effective for controlling the position of the gelastic cushion but it results in the gelastic cushion hammocking the patient. One embodiment of the present invention solves this problem.

SUMMARY OF THE PRESENT INVENTION

The present invention is directed to a gelastic cushion. The gelastic cushion is made from a conventional gelastic composition. The gelastic cushion has a structure having a first wall that defines an opening area and buckles when a force is applied to the first wall. When the first wall buckles a predetermined amount, a second wall, interconnected to the first wall and made of a gelastic composition, also buckles. The second wall decreases the chance that the first wall bottoms out. Bottoming out is when the patient essentially contacts the underlying surface which results in an increase of the pressure on the patient (a.k.a., the force) overlying the gelastic cushion. That increased pressure is undesirable.

BRIEF DESCRIPTION OF THE DRAWINGS

Various cross-hatching lines are used in the figures to identify different structural components. Those structural components having different cross-hatching in the figures can be the same material or different materials.

DETAILED DESCRIPTION OF THE PRESENT INVENTION

Figure 1:
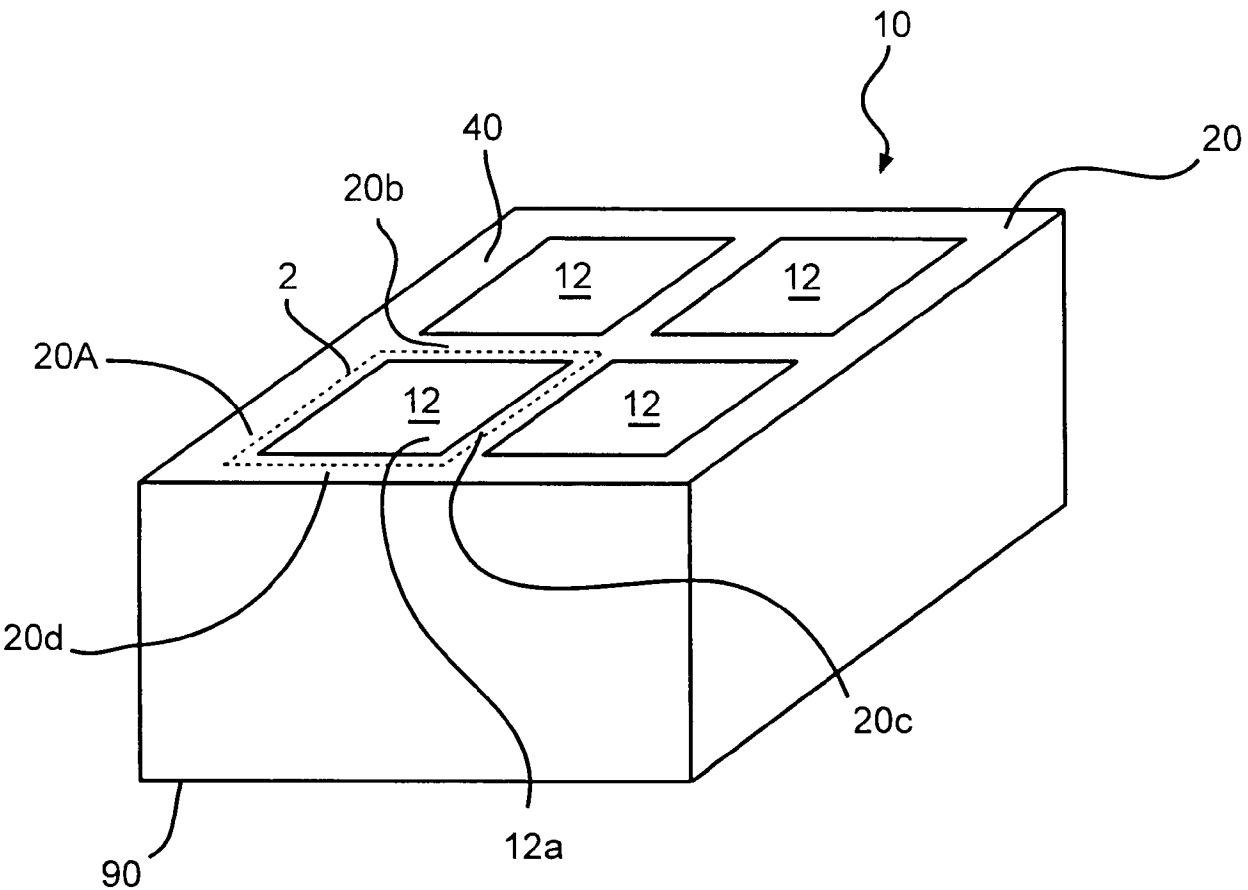
FIG. 1 illustrates an isometric view of the present invention.

FIG. 1 illustrates a gelastic cushion 10 having a first wall 20 defining opening areas 12 positioned throughout the gelastic cushion 10. To understand and appreciate the present invention, we must look at (1) FIG. 2 which is an overview of FIG. 1 at the area identified as box 2 (for illustration purposes only the first wall 20 in box 2 has been defined as first walls 20*a-d* and a portion of the opening area 12 in box 2 is defined as opening area 12*a*) and (2) FIG. 3 which is a cross-sectional view of FIG. 2 taken along the lines 3-3.

Figure 3:
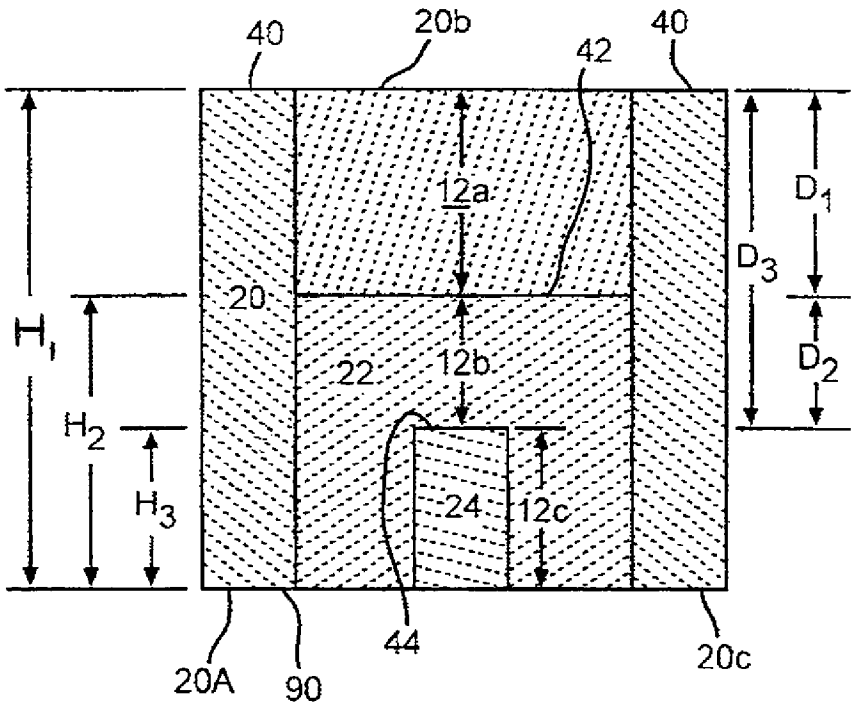
FIG. 3 is a cross-sectional view of FIG. 2 taken along the lines 3-3.
Figure 2:
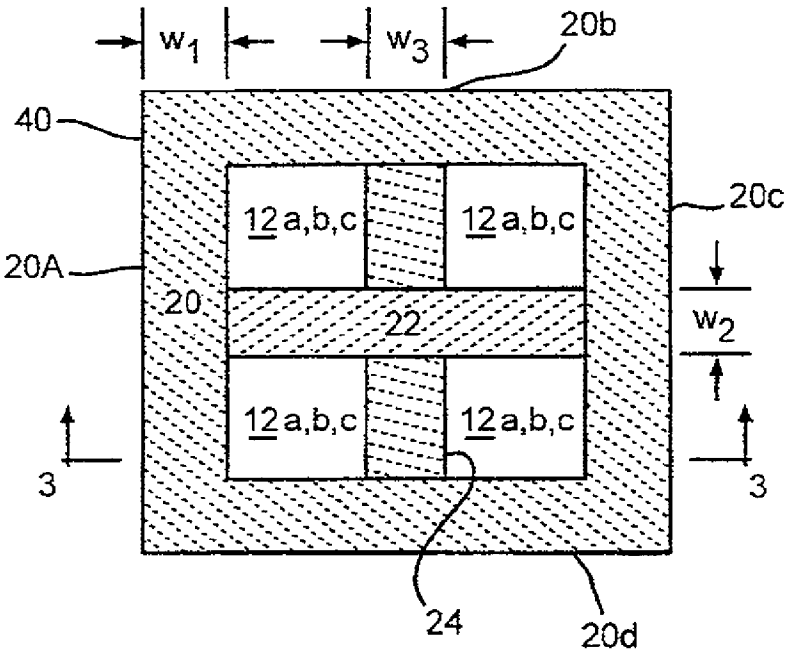
FIG. 2 is a top view of FIG. 1 taken only at box 2.

FIGS. 2 and 3 illustrate three walls 20, 22, 24. The first wall 20 is the tallest wall and it defines the first opening area 12*a* (see FIG. 1) and has a height H1 (see FIG. 3). The first wall 20 has a width W1 that allows it to buckle into the first opening 12*a*, a second opening 12*b* (defined below), a third opening 12*c* (defined below) or alternatively in (a) a corresponding opening 12 (see FIG. 1) and/or (b) exterior to the perimeter of the gelastic cushion 10. The first wall 20 has a top surface 40 that receives a patient thereon.

The second wall 22(*a*) is an intermediate wall height that has a height H2 and (b) defines with the first wall 20 at least two second openings 12*b*. The difference between H1 and H2 is distance D1. The second wall 22 has a width W2 that allows it to buckle into the second opening 12*b* or the third opening 12*c* if a patient's weight (and/or a force is applied to the gelastic material) is sufficient to buckle the first wall 20 a distance D1+. D1+ is any distance greater than D1 and W1 and W2 can be the same width or different widths.

The third wall 24(*a*) is a lower wall height and has a height H3 and (b) defines with the first wall 20 and the second wall 22 at least four third openings 12*c*. The difference between H1 and H3 is distance D3 and the difference between H2 and H3 is distance D2. The third wall has a width W3 that allows it to buckle if a patient's weight (and/or a force is applied to the gelastic material) is sufficient to buckle (a) the first wall 20*a* distance D3+ and (b) the second wall 22*a* distance D2+. D2+ is any distance greater than D2 and D3+ is any distance greater than D3. W1, W2 and W3 can be the same width, different widths or combinations thereof.

Operation of the Gelastic Cushion

Figure 5:
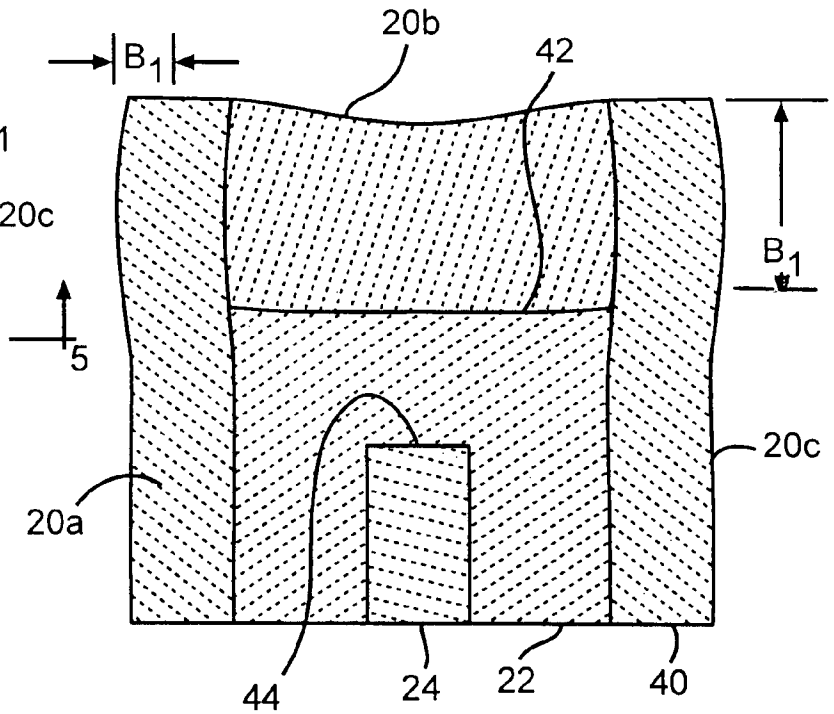
FIG. 5 is a cross-sectional view of FIG. 4 taken along the lines 5-5.
Figure 4:
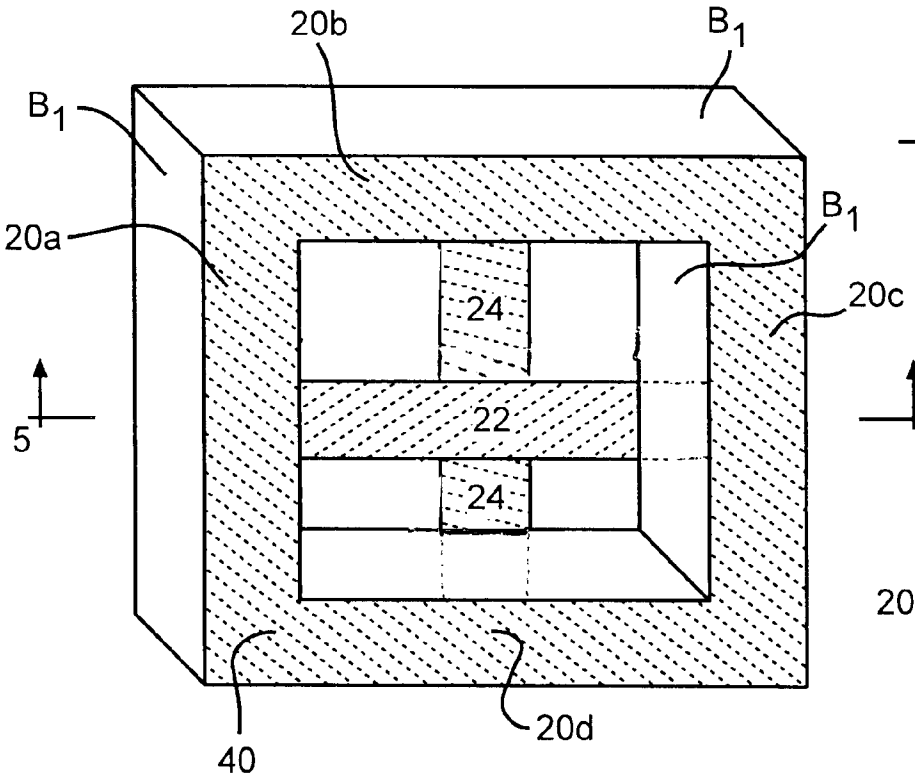
FIG. 4 illustrates a first embodiment of a top view of FIG. 2 when an object buckles just the first wall.

Turning to FIGS. 4 and 5, if an object (not shown) is positioned on the gelastic material 10 and the object's weight causes the first wall 20 (each portion of the first wall is identified individually as 20*a*, 20*b*, 20*c* and in other figures 20*d*) to buckle (B1) a distance D1−. D− is a distance less than D1, or a distance D1. When the first wall 20 only buckles a distance D1− the second wall 22 and the third wall 24 do not buckle, as illustrated in FIGS. 4 and 5. Instead the second wall 22 and the third wall 24 can be stretched (redistribution or lessening of the load) to accommodate the buckling (B1) of the first wall 20.

Figure 7:
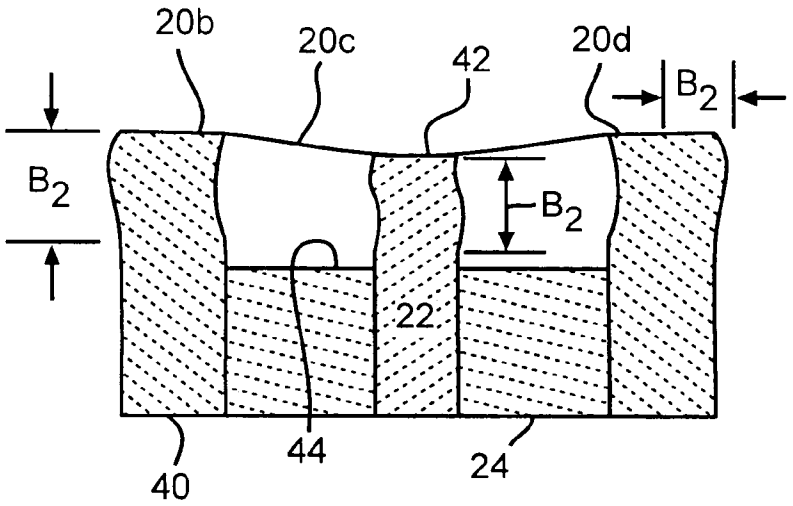
FIG. 7 is a cross-sectional view of FIG. 6 taken along the lines 7-7.
Figure 6:
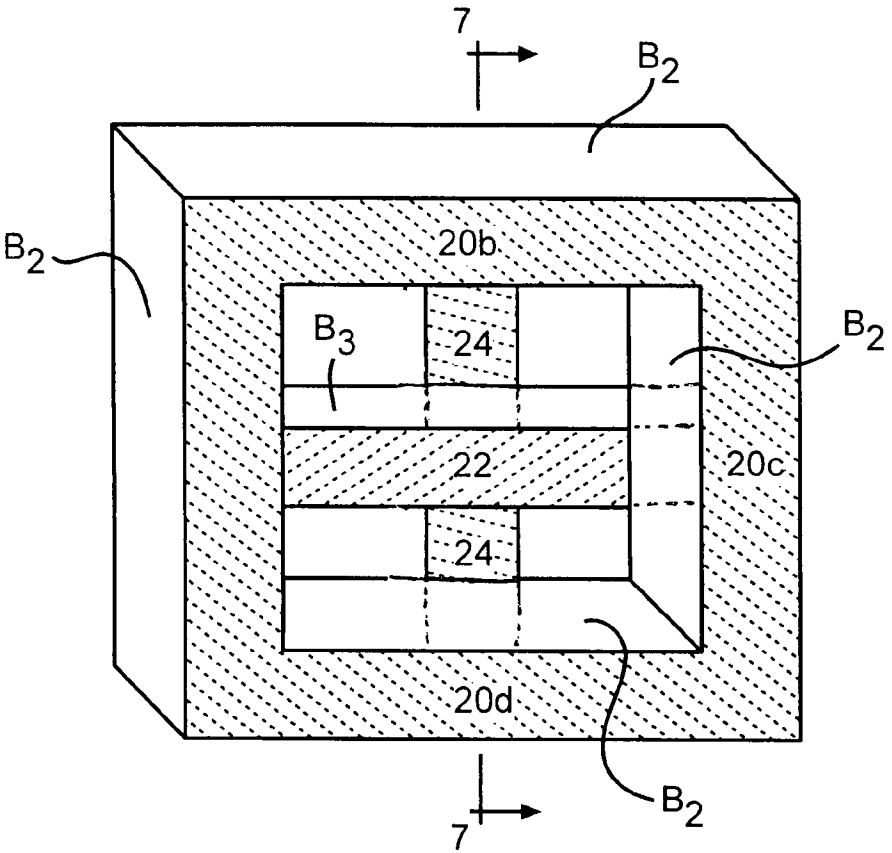
FIG. 6 illustrates a second embodiment of a top view of FIG. 2 when an object buckles the first wall and the second wall, not the third wall.

FIGS. 6 and 7 illustrate when an object (not shown) is positioned on the gelastic material 10 and the object's weight causes the first wall 20 to buckle (B2) a distance D1+ which then means that the second wall 22 buckles (B3). In FIGS. 6 and 7 the second wall 22 buckles (B3) a distance D2− and the first wall buckles (B2) a distance D3− so that the third wall 24 does not buckle but can be stretched to accommodate the buckling of the first wall 20 and the second wall 22. D3− is a distance less than D3 and D2− is a distance less than D2. When the second wall 22 buckles, the second wall 22 provides increased support to the object to distribute the patient's weight when the first wall 20 buckles a predetermined distance D1+.

When the second wall 22 buckles, the present invention provides a similar support as the stacked cushion embodiment that was disclosed in the prior art. The similarities between the present invention and the stacked cushion embodiment differ in that there is no material used to interconnect two different cushions. That interconnection could (a) increase pressure on the patient or (b) be defective so the stacked cushions separate from each other. The present invention avoids those potential problems by having multiple height buckling walls within and surrounding each opening area 12.

The multiple heights buckling walls within and surrounding each opening area 12 differs from the multi-tiered embodiment disclosed in the prior art. The multi-tiered embodiment does not have each tier buckle uniformly because the thicker sections do not buckle as well as the thinner section. The present invention has each wall of the multiple heights buckling wall buckle essentially uniformly when the appropriate force is applied to it which provides the desired distribution of weight and decreased pressure on the patient.

As indicated above, the third wall 24 buckles when the first wall 20 buckles a distance D3+ and the second wall 22 buckles a distance D2+. Even though not shown, when the third wall 24 buckles the third wall 24 provides further support to (1) decrease any pressure on the patient and (2) distribute the patient's weight when the first wall 20 buckles a predetermined distance D3+ and the second wall 22 buckles a distance D2+.

How Made

The example illustrated in FIG. 1 shows first walls in a rectangular shape (which includes a square). The first walls can be any shape including circles, pentagons, hexagons (as alluded to in FIGS. 8 and 9) or any other desired shape that will allow the first wall and the second wall (and possible other walls) to buckle as desired.

Figure 9:
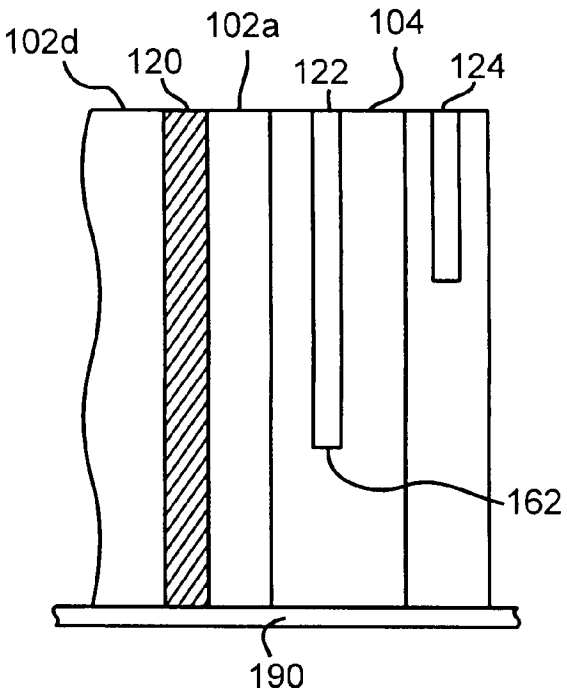
FIG. 9 is front view of FIG. 8 taken along the lines 9-9 that illustrates component 102*a* and a portion of component 102*d*.
Figure 8:
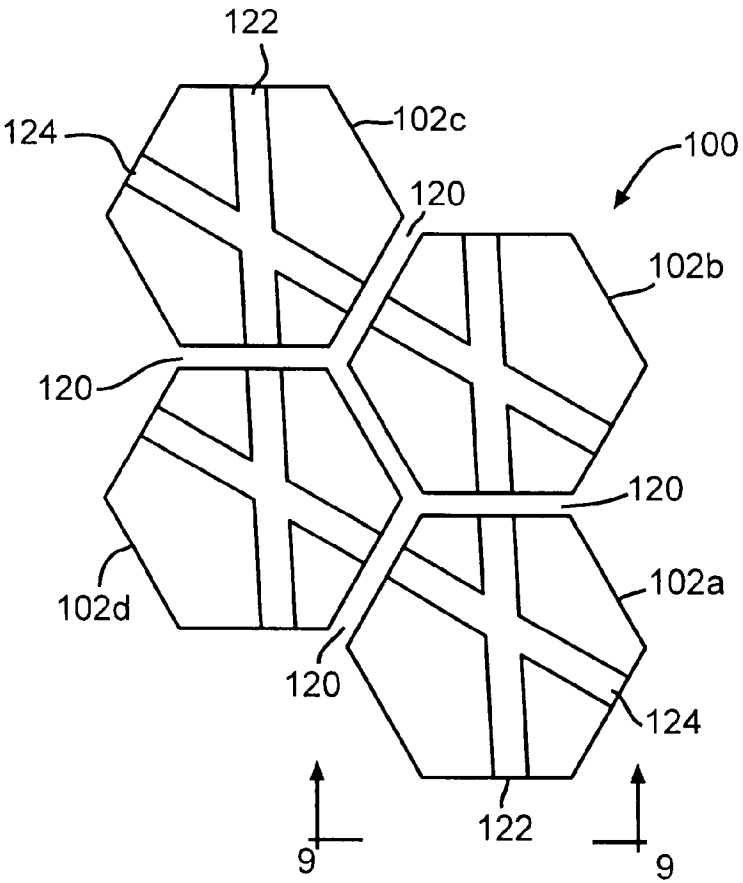
FIG. 8 is top view of mold components to form one embodiment of the present invention.
Figure 11:
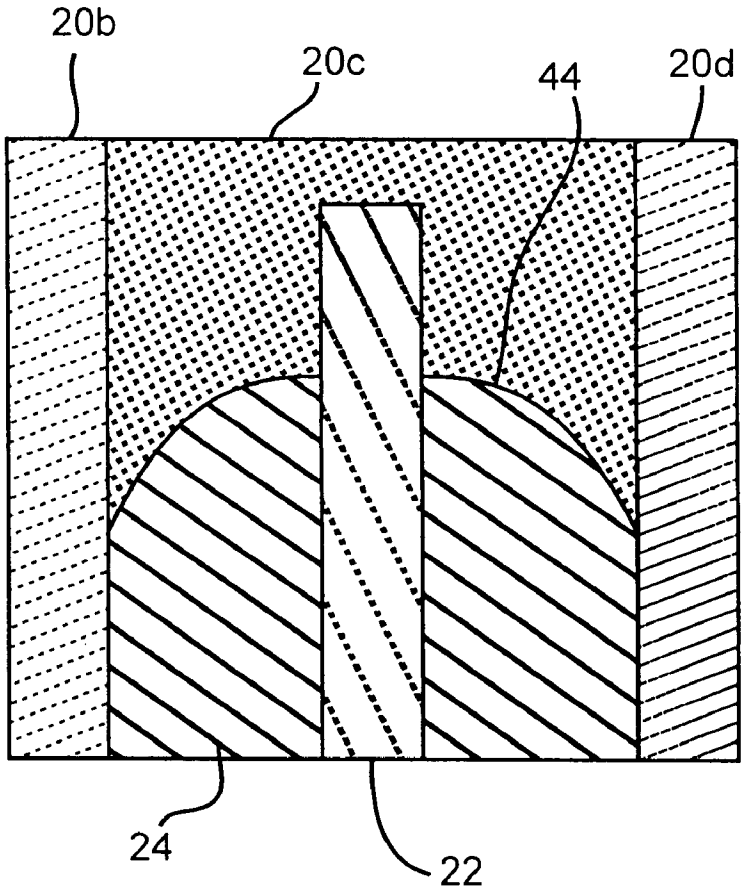
FIG. 11 illustrates FIG. 10 taken along the lines 11-11.
Figure 10:
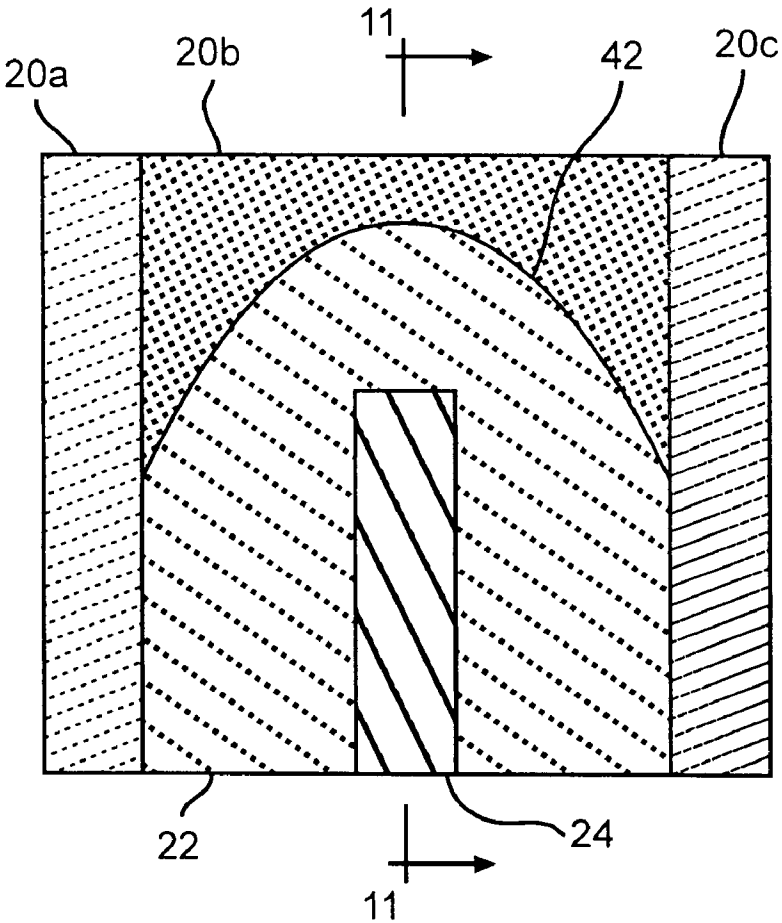
FIG. 10 illustrates an alternative embodiment of FIG. 3.
Figure 13:
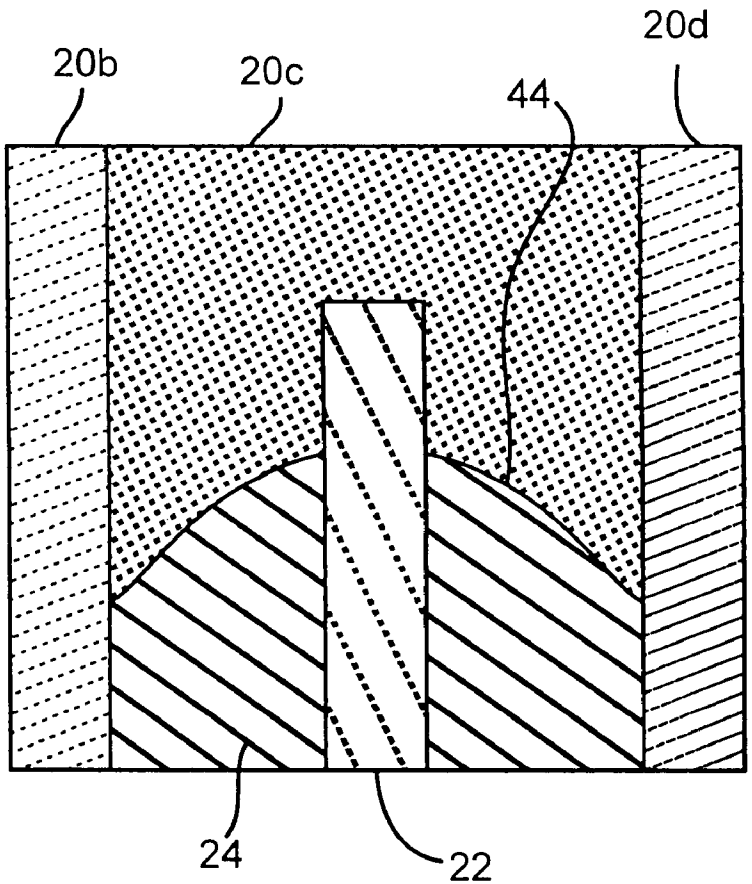
FIG. 13 illustrates FIG. 12 taken along the lines 13-13.
Figure 12:
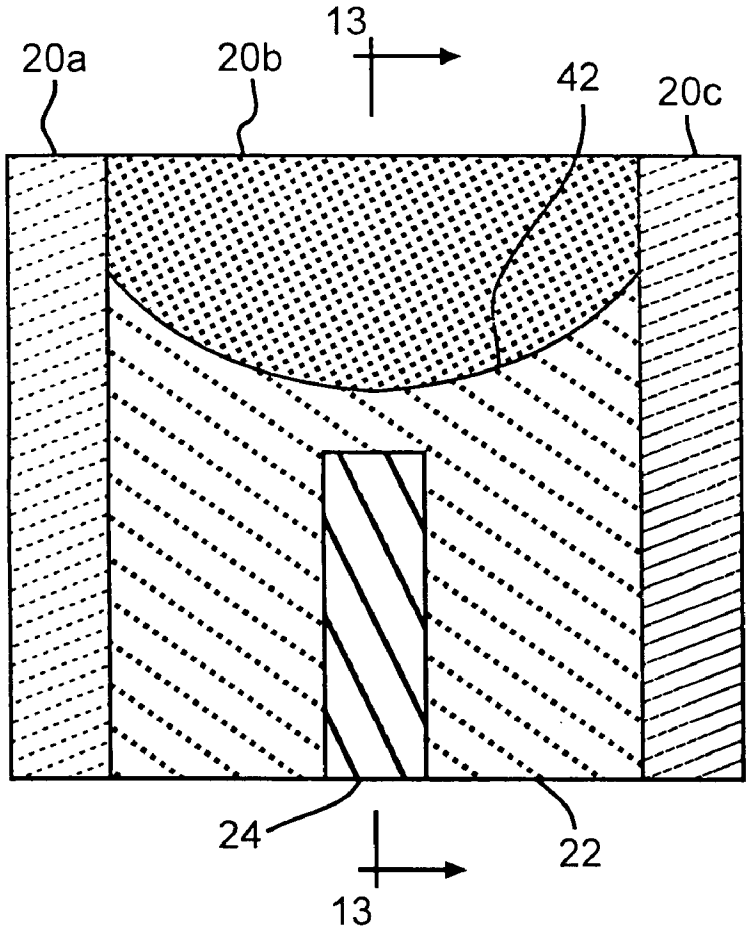
FIG. 12 illustrates an alternative embodiment of FIG. 3.
Figure 15:
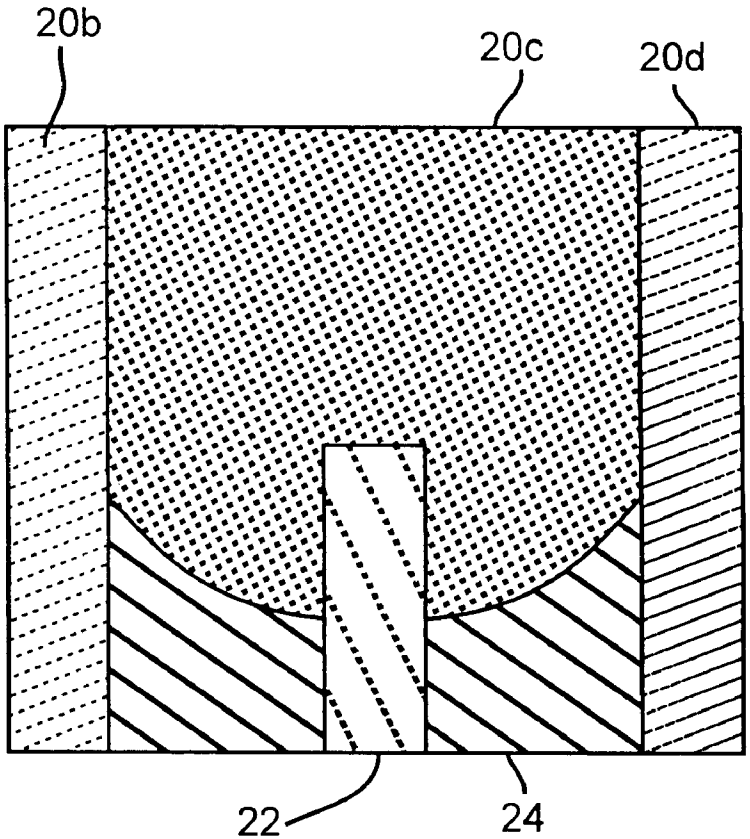
FIG. 15 illustrates FIG. 14 taken along the lines 15-15.
Figure 14:
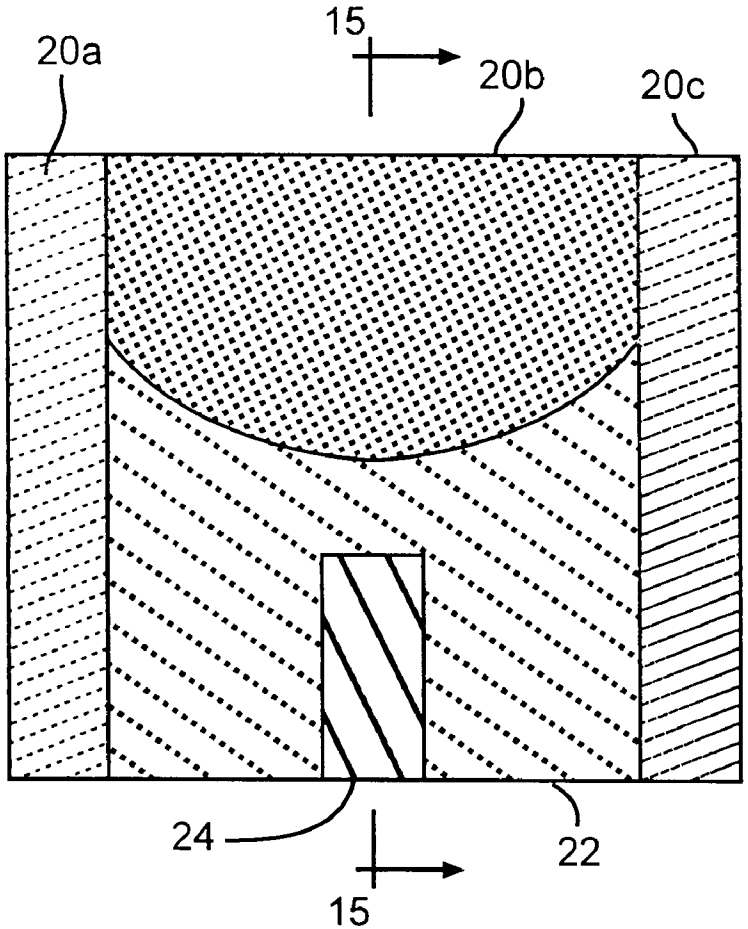
FIG. 14 illustrates an alternative embodiment of FIG. 3.
Figure 17:
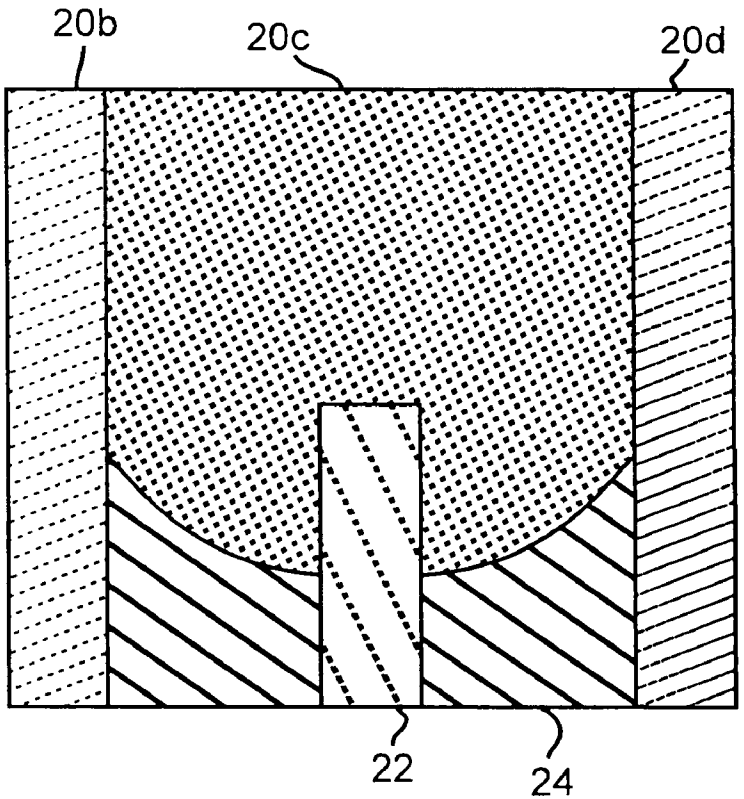
FIG. 17 illustrates FIG. 16 taken along the lines 17-17.
Figure 16:
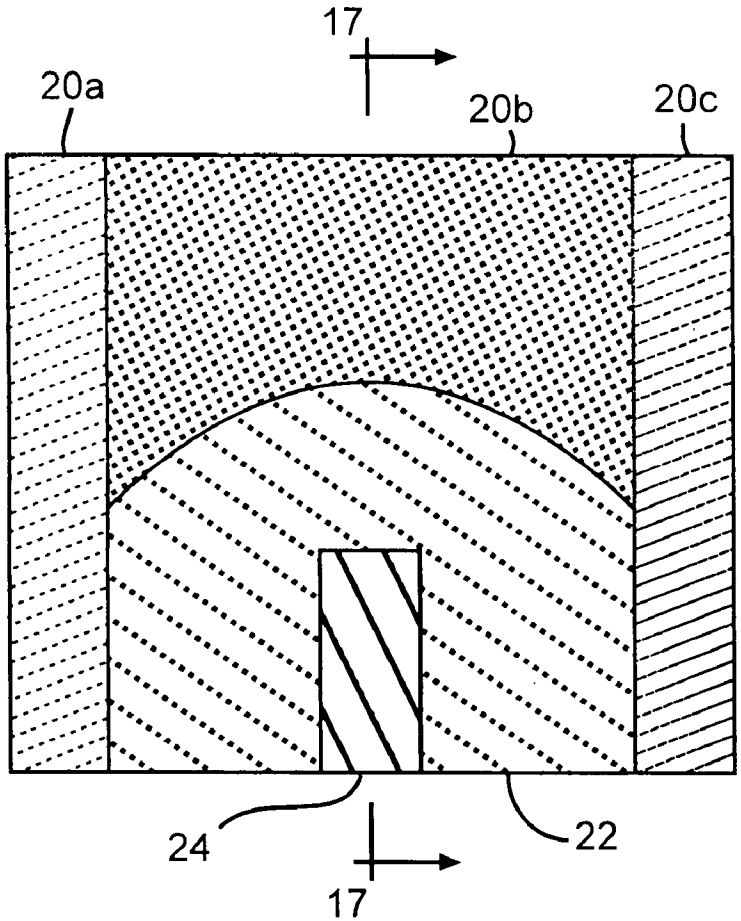
FIG. 16 illustrates an alternative embodiment of FIG. 3.

FIGS. 8 and 9 illustrate four components 102*a,b,c,d* of a mold 100 that form an embodiment of the gelastic cushion 10 having multiple heights buckling walls within and surrounding an opening area. The mold 100 is a conventional mold having components that can withstand the gelastic material in a molten state. That material can be metal, polymeric and/or combinations thereof.

The mold 100 as illustrated in FIG. 8 shows four components 102*a,b,c,d*, in a hexagonal shape. The gelastic material is poured onto the mold 100 and the gelastic material that falls within (a) the gaps 120 form the first walls 20, (b) the gaps 122 form the second walls 22 and (c) the gaps 124 form the third walls 24. FIG. 8 illustrates the top of the mold 100, which illustrates the gelastic cushion's bottom surface 90.

FIG. 9 illustrates component 102*a* and a portion of component 102*d* from arrow 9 in FIG. 8. As alluded by FIGS. 2 to 9, the first wall 20 is defined by (a) the gap 120 positioned between the various components 102*a,b,c,d* and (b) a bottom surface 190 of the mold 100 (the top 90 of the gelastic material 10). In contrast the second wall 22 is defined entirely by the gap 122 in each component 102, and the third wall 24 is defined entirely by the gap 124 in each component 102.

As illustrated in FIGS. 3, 5, and 7, the second wall 22 has a top surface 42 that is level and the third wall 24 has a top surface 44 that is level. Those top surfaces 42, 44 can also be concave, convex, level or combinations thereof. Examples, and not limitations, of those embodiments are illustrated in FIGS. 10 to 17. Those alternative embodiments for the top surfaces 42, 44 can be defined by altering the shape in the gaps 122, 124 in each component. It is well known that concave, convex and level top surfaces can strengthen, weaken or maintain the present support of the first wall 20, the second wall 22 and/or the third wall 24. By having various shaped top surfaces 42, 44 in different portions of the gelastic cushion, the gelastic cushion 10 can have various levels of support provided by the various walls 20, 22, 24 throughout the gelastic cushion 10.

Bottom Layer

Figure 18B:
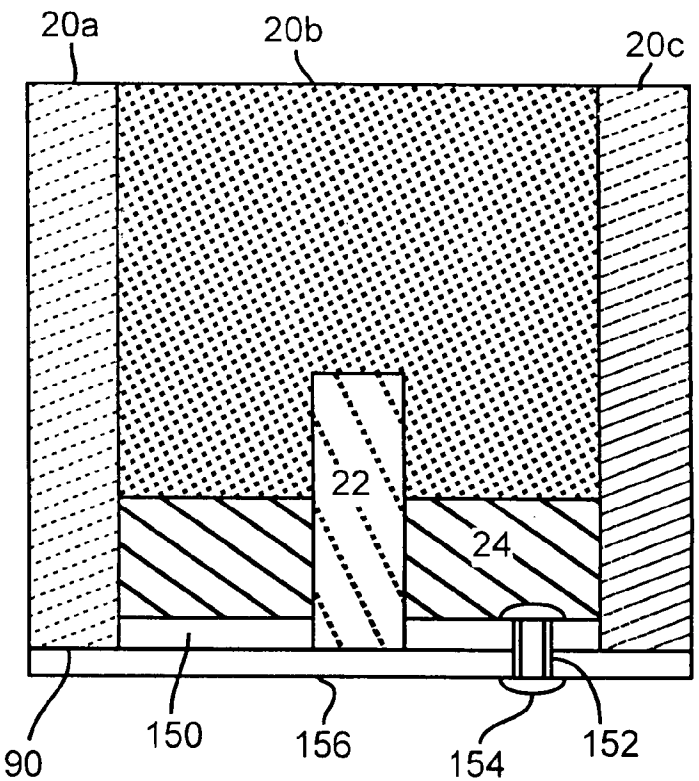
FIGS. 18*a* and *b* illustrate alternative embodiments of FIG. 3 with a bottom (skin) layer, an aperture, and an interconnector.
Figure 18A:
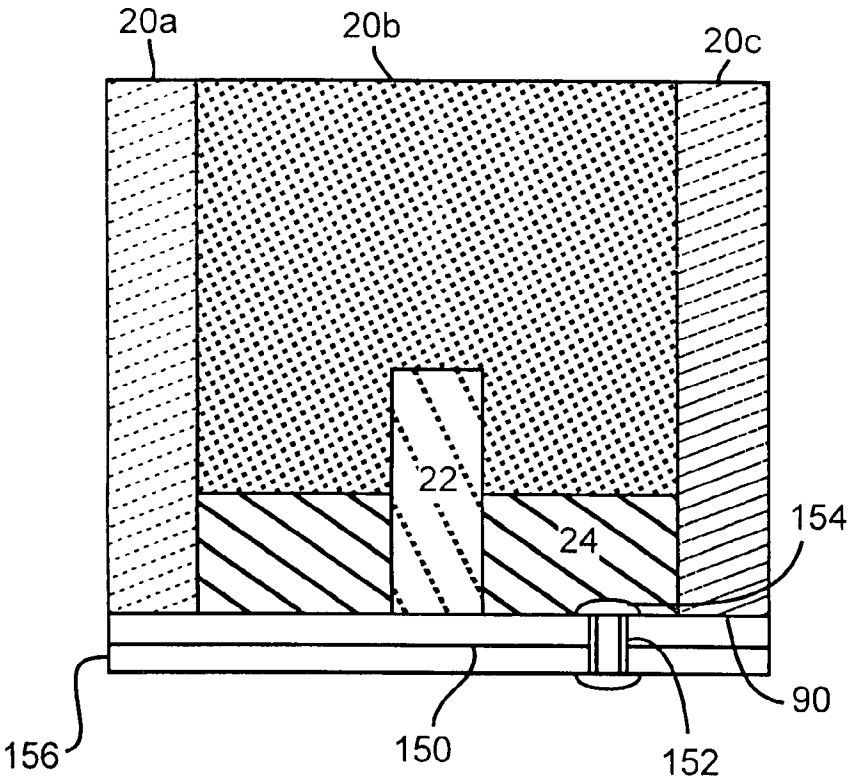

The bottom 90 of the gelastic material 10 can have a bottom layer (a.k.a., skin layer) 150 as illustrated in FIG. 18*a* that extends beyond the bottom of the rest of the gelastic material, or as illustrated in FIG. 18*b* that is in the same plane as the bottom surface 90 of the gelastic material 10. That bottom layer 150 has a thickness TH1. The bottom layer 150 can provide additional support to the gelastic cushion 10. Adding the bottom layer 150 can be easily accomplished in the molding process by merely adding sufficient gelastic material over the components' 102 top surface 104 (see FIG. 9) to a desired thickness, which is TH1. Alternatively, the molding process can have an indentation in certain areas of the mold components 102 for skin layer to have the desired thickness or just overflow the mold so the skin layer obtains the desired thickness.

Figure 20:
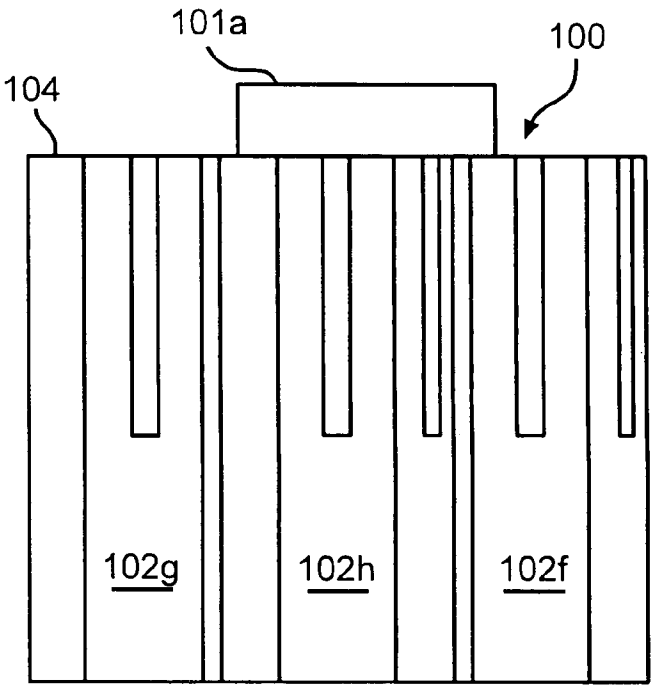
FIG. 20 illustrates a front view of FIG. 19 taken from arrow 20.
Figure 19:
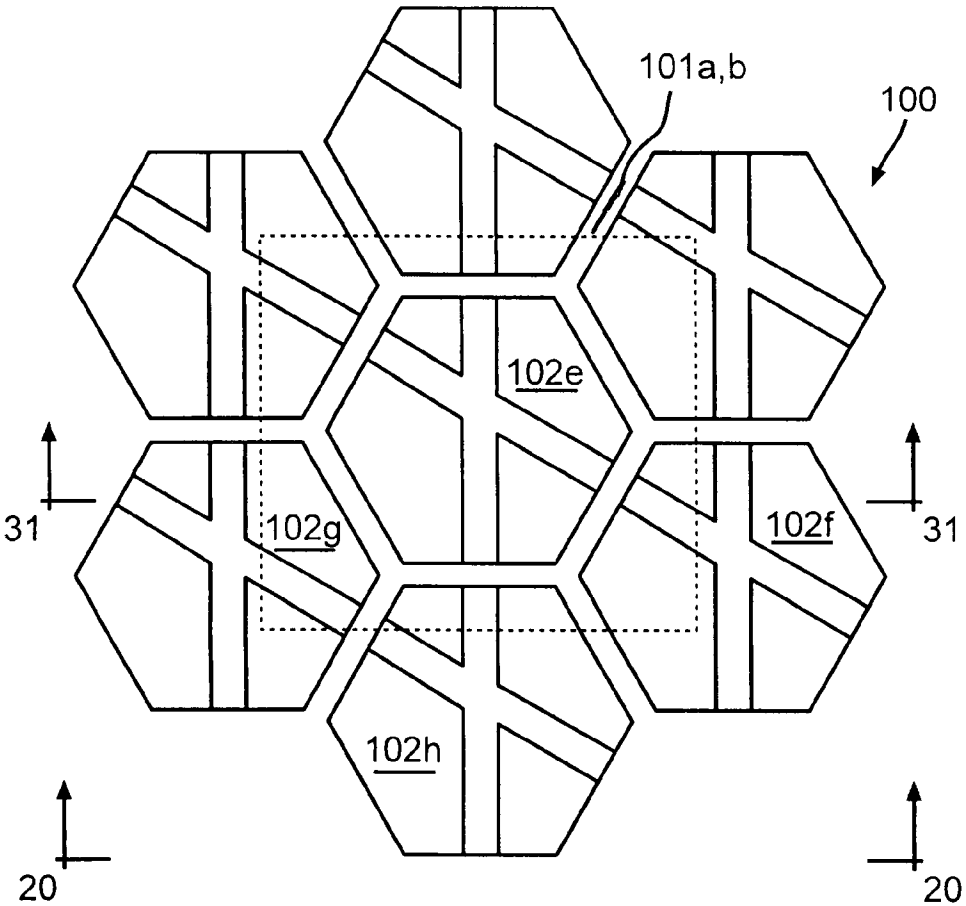
FIG. 19 illustrates an alternative embodiment of FIG. 8 with an extra mold positioned on a mold component or an indentation in the mold component.
Figure 31:
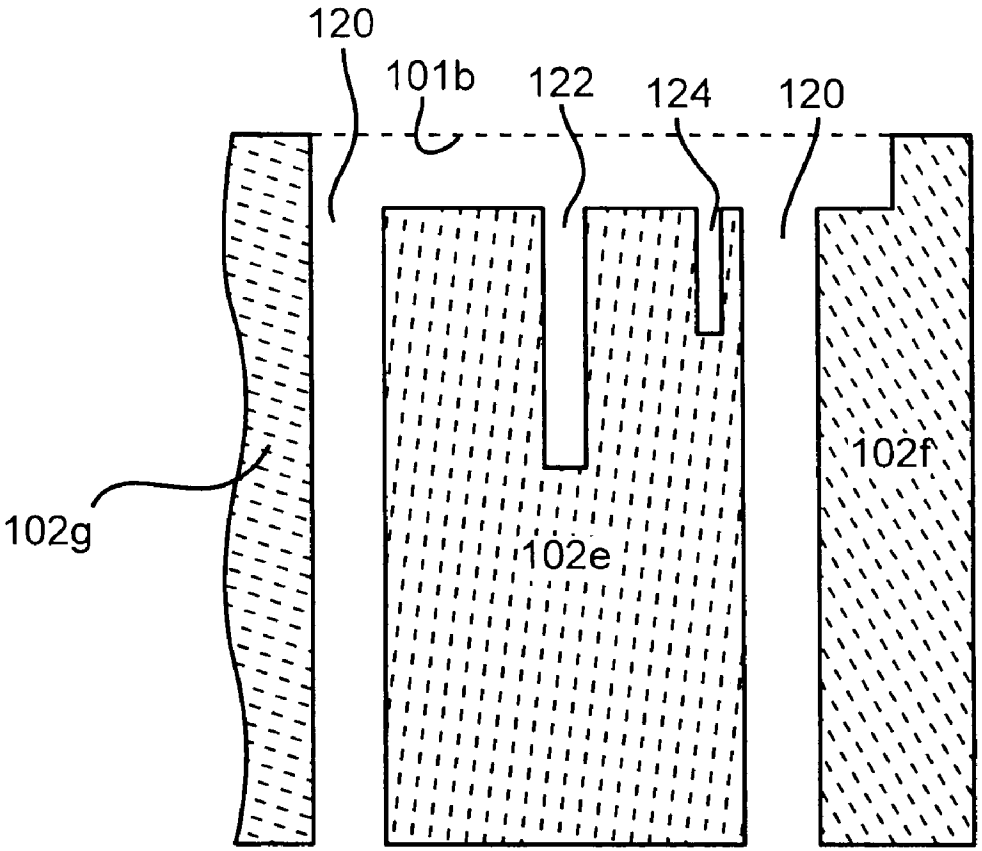
FIG. 31 is a cross-sectional view of FIG. 19 taken along the lines 31-31.

It should be noted that the bottom layer 150 can be positioned at certain desired bottom 90 areas of the gelastic cushion 20 or the entire bottom 90 area. The former embodiment can be accomplished by adding an excess mold component 101*a* on the mold components 102*e-f* as illustrated at FIGS. 19 and 20, or an indentation 101*b* in the mold components 120*e-f* as illustrated at FIGS. 19 and 31 to desired area of the top surface 104 of the mold components 120 to allow the manufacturer to add additional gelastic material to that certain area and not others. In the embodiment illustrated, the extra material is referred to as a skin layer or a bottom layer 150.

Connectors and/or Apertures

The bottom layer 150 can have apertures 152 as illustrated in FIGS. 18*a* and 18*b*. Those apertures 152 can be formed in the molding process and/or by insertion of connectors 154 through the bottom layer 150. The connectors 154 connect the gelastic cushion 10 to a desired apparatus 156—another cushion (foam, bladders), support frame (furniture like chairs and mattresses, or crib materials), or combinations thereof. The connectors 154 can be metal, plastic or combinations thereof. Examples of connectors 154 include nails, screws, rivets, hooks, loops, or equivalents thereof.

By utilizing the bottom layer 150 with the connectors 154, the present invention does not have the gelastic cushion adhere to a non-woven or other material as done in the prior art. The connectors 154 ensure the gelastic material does not move around with less materials than needed than the prior art method.

Independent Column Walls

Figure 21:
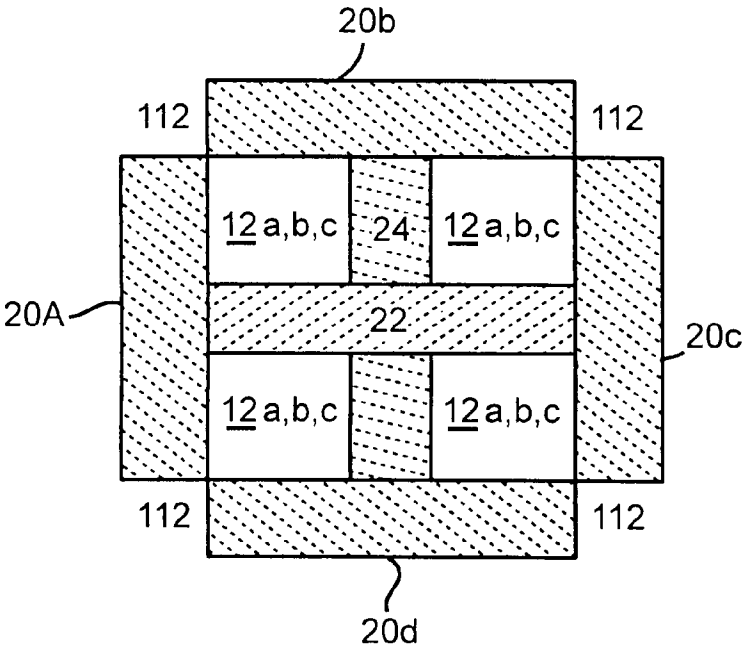
FIG. 21 illustrates an alternative embodiment of FIG. 2.

In some embodiments, it is desired that each column wall (for example first wall 20*a*) is independent from the other column walls (first walls 20*b,d*) by apertures (or gaps) 112 positioned between the respective column walls as illustrated in FIG. 21. That independence is limited in that the column walls are interconnected to the second wall 22 and/or the third wall 24. The aperture 112 can be any sized aperture so long as the column walls are independent from each other. This embodiment decreases excessive buckling and therefore decreases undesired hammocking effect.

Tailored Top

Figure 22:
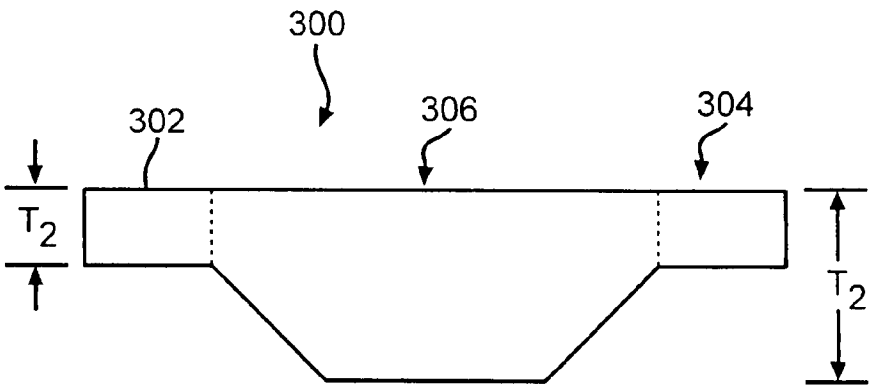
FIG. 22 illustrates a mattress configuration that uses the present invention.

It is well known that a patient normally applies more pressure to a mattress cushion in the pelvic and torso areas than the foot or the head areas. In view of this information, the applicants have designed a tailored top cushion 300 as illustrated in FIG. 22. The tailored top cushion 300 can be divided into at least three zones. The first zone 302 provides support to a patient's head area, the second zone 304 provides support to the patient's foot area, and the third zone 306 supports the patient's heavy area—the pelvis and torso area.

Since the third zone 306 supports the patient's heavy area, the third zone 306 uses the gelastic cushion structures of the present invention. The gelastic cushion structures of the present invention have (1) a first wall 20 (a) having a height H1, (b) able to be buckled when a force is applied, and (c) defines an opening 12 even though the first wall 20 may have gaps at certain points and (2) within the opening 12 is a second wall 22 (a) having a height less than H1, (b) able to be buckled when the first wall buckles beyond a predetermined point, and (c) that interconnects to two locations on the first wall 20.

The first and second zones 302, 304 can use conventional gelastic cushion structures that are used in the prior art or the gelastic cushion structures of the present invention. That way, mattress 300 does not have to use as much gelastic material.

Alternatively, the third zone 306 can have a thickness of T1 while the first zone 302 and the second zone 304 can have a thickness of T2, which is less than T1. That increased thickness in the third zone 306 provides increased locations for the second wall 22 and additional walls including the third wall 24 to be positioned within the respective opening areas 12.

How Used

Figure 23:
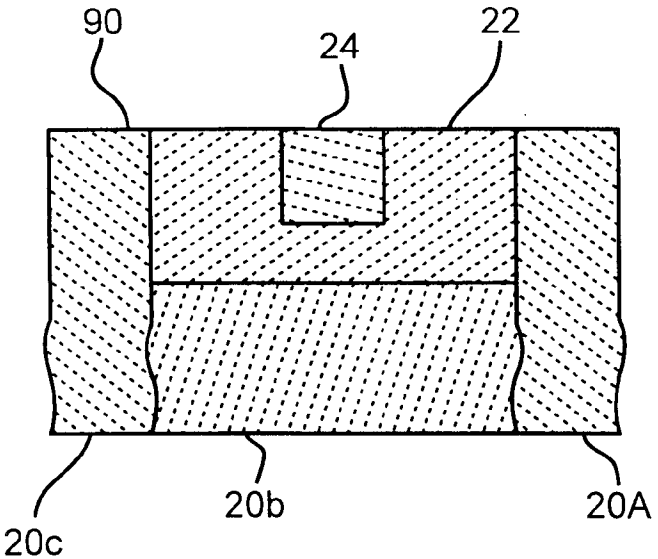
FIG. 23 illustrates an alternative embodiment of FIG. 3 wherein the cushion is used upside down.

The present gelastic cushion material can be flipped over when used. By flipped over, the above-identified bottom layer 90 becomes the layer that the patient contacts. That way the present gelastic cushion material has increased surface area applied to the patient which can decrease the pressure applied to the patient. When the cushion material is flipped over, as illustrated in FIG. 23, the first wall, the second wall and the third wall buckle in the same way as described and illustrated above, except upside down.

Jigsaw Embodiment

Figure 24:
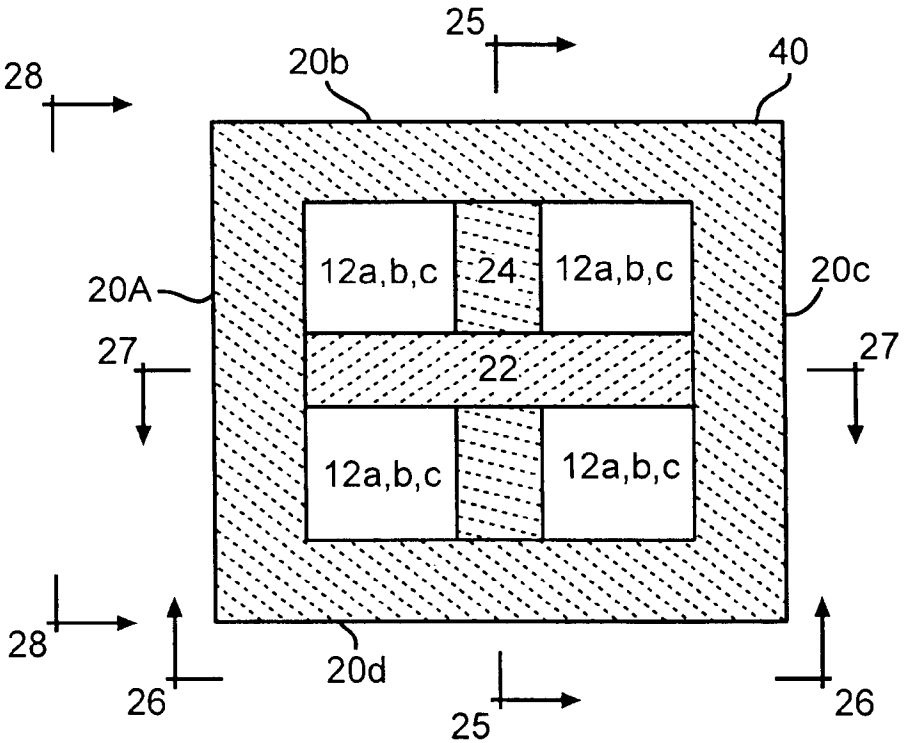
FIG. 24 illustrates an alternative embodiment of FIG. 2 using a jigsaw embodiment.
Figure 25:
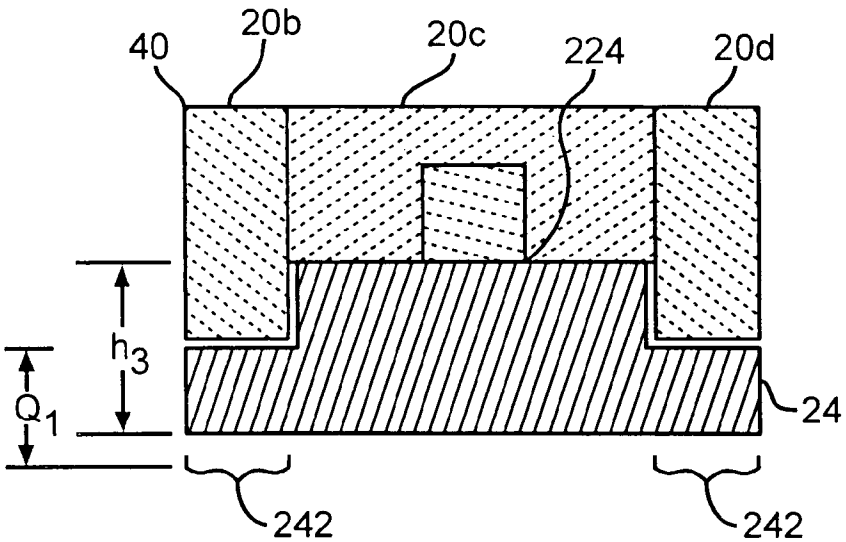
FIG. 25 is a cross-sectional view of FIG. 24 taken along the lines 25-25.

The present gelastic cushion material can also be made of parts interconnected together. This jigsaw embodiment allows (1) the first wall 20 to be made of a first gelastic material having a durometer value of a; (2) the second wall 22 to be made of the first gelastic material or a second gelastic material having (i) a durometer value of a or b (wherein durometer value of b is different from the durometer value of a) and/or (ii) a composition different from the first gelastic material; and (3) the third wall 24 to be made of the first gelastic material, the second gelastic material or a third gelastic material having (i) a durometer value of a, b or c (wherein the durometer value of c is different from the durometer values of a and b) and/or (ii) a composition different from the first and second gelastic materials. Each wall material 20, 22, 24 interconnects to each other wall like a three dimensional jigsaw puzzle. Examples of such three dimensional jigsaw puzzle embodiments are illustrated in FIGS. 24 to 30. In particular, FIG. 24 illustrates an alternative embodiment of FIG. 2—a top view of a designated top section 40 of the present multi-walled of different height gelastic cushion material. FIG. 25 is a cross-sectional view of FIG. 24 taken along the lines 25-25. In FIG. 25, the third wall 24 retains its height (h3) between the interior section of first wall 20*b* and 20*c*. Implicitly illustrated in FIG. 25 is the fact that second wall 22 has a gap area 224 (a high gap area) that allows the third wall 24 to retain its height between the interior section of first wall 20*b* and 20*d*.

Figure 26:
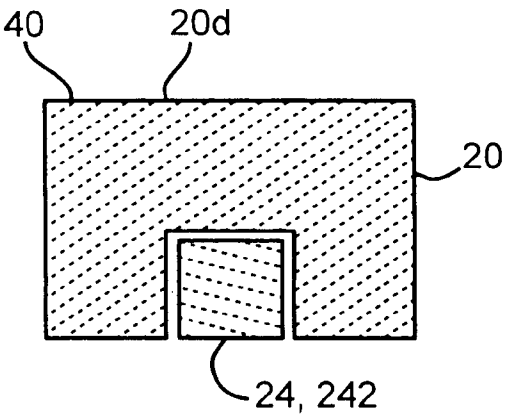
FIG. 26 is a view of FIG. 24 taken along the lines 24-24.
Figure 29:
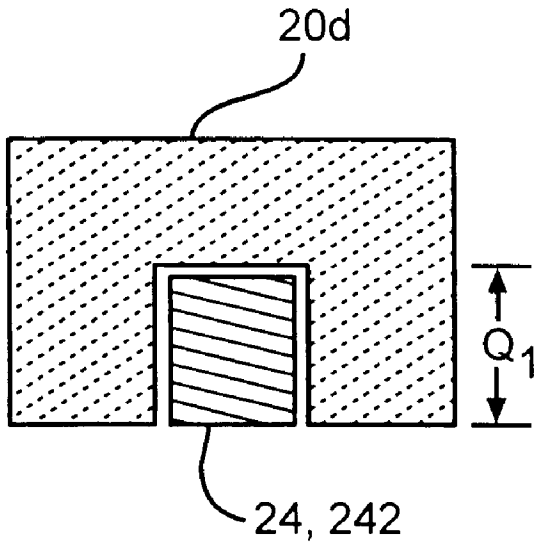
FIG. 29 is an alternative embodiment of FIG. 26.

FIGS. 25, 26 (a view of FIG. 24 taken along the lines 26-26) and 29 (an alternative embodiment of FIG. 26) illustrate the third wall 24 has projections 242 having a height (Q1). The height Q1 can be any level that allows the third wall 24 to interconnect with the first wall 20 as illustrated in FIGS. 26 and 29.

Figure 28:
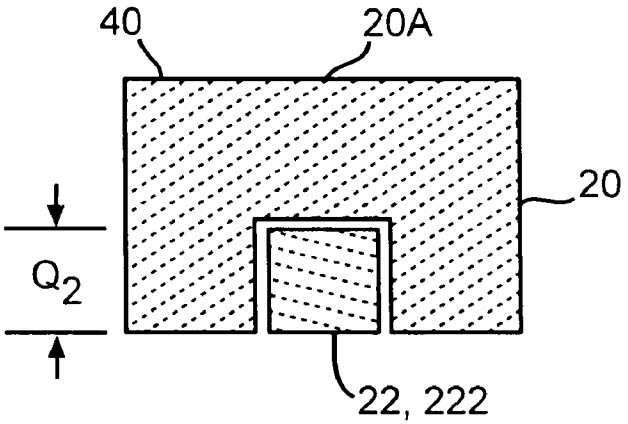
FIG. 28 is a view of FIG. 24 taken along the lines 28-28.
Figure 27:
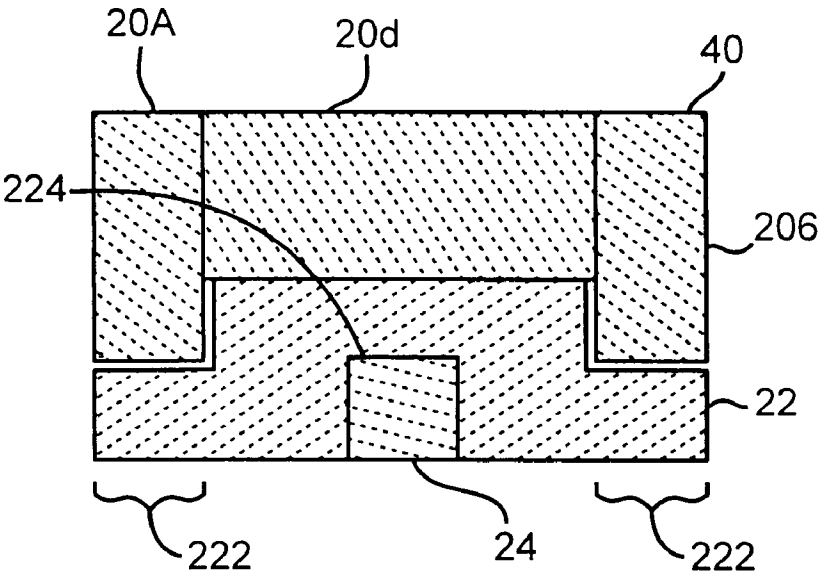
FIG. 27 is a cross-sectional view of FIG. 24 taken along the lines 27-27—a different embodiment when compared to FIG. 25.
Figure 30:
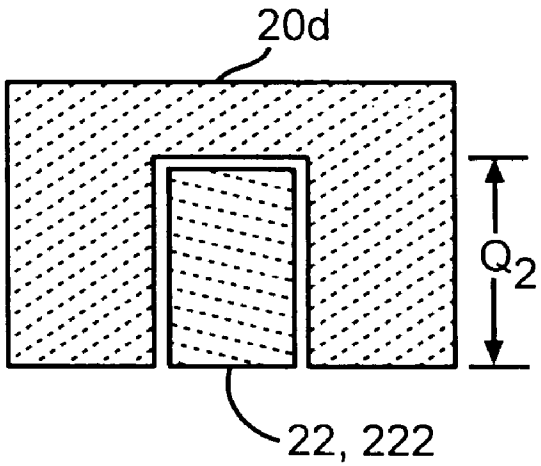
FIG. 30 is an alternative embodiment of FIG. 28.

FIG. 27 illustrates an alternative embodiment of FIG. 24 taken along the lines 27-27 wherein the second wall 22 has a small gap area 224 that requires the third wall 24 to not retain its height (h3) between the interior section of first wall 20*b* and 20*d*. FIGS. 27, 28 and 30 illustrate the second wall 22 has projections 222 having a height (Q2). The height Q2 can be any level that allows the second wall 22 to interconnect with the first wall 20 as illustrated in FIGS. 28 and 30.

If this embodiment is used, each wall 20, 22, 24 is to be molded individually if the gelastic materials are all different gelastic compositions and/or durometer strengths. If two of the walls are of the same material and durometer strength, then those two walls can be molded together while the last wall is molded individually and then later interconnected with the two walls.

Filler

The gelastic cushion material can have filler positioned within the opening areas 12. The filler can be a fluid like water or an aqueous liquid, a gel material, bead material like polyethylene beads, down, horsehair, and combinations thereof. The filler can strengthen, maintain, or weaken the gelastic walls material.

Adjusting Wall Strength

Figure 32:
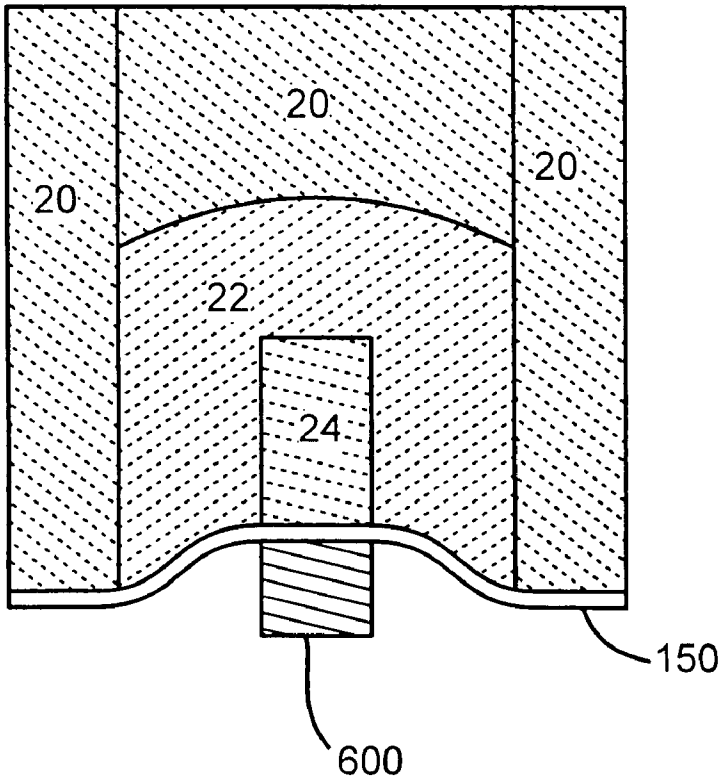
FIG. 32 is an alternative embodiment of FIG. 3.

If the embodiment with a skin layer 150 is used, the walls 20, 22, 24 of the present gelastic cushion material can be strengthened by positioning a peg 600, as illustrated in FIG. 32 under the skin layer 150. Depending on the size of the peg 600, the gelastic cushion material's walls can be strengthened by pulling the walls closer together when the skin layer 150 is positioned over the peg 600. The peg 600 can be any material like wood, gelastic material, metallic, polymeric or combinations thereof.

Alternatively, the peg 600 can be positioned below a gelastic material without any skin layer 150 but having the peg positioned below the first wall 20, the second wall 22, the third wall 24 or combinations thereof.

Figure 33:
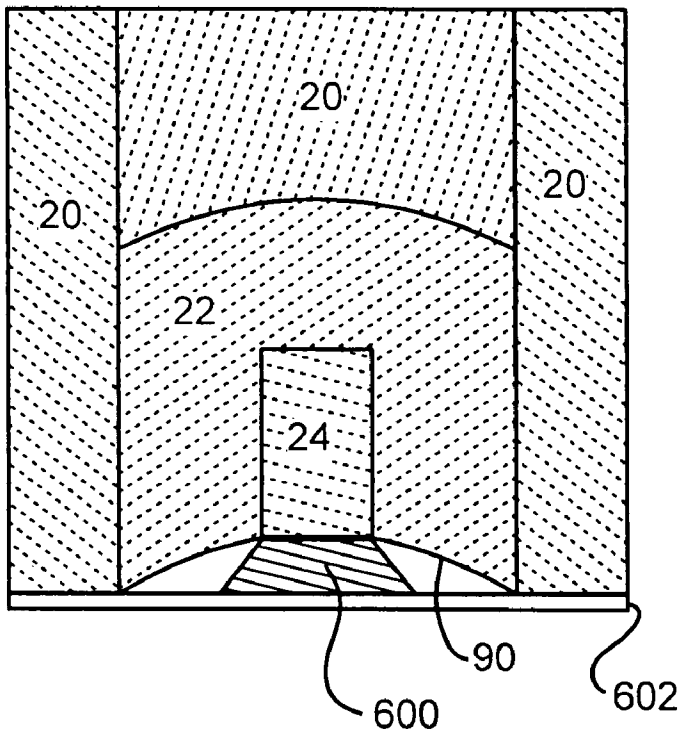
FIG. 33 is an alternative embodiment of FIG. 3.

Another embodiment of using the peg 600 is illustrated at FIG. 33, the peg 600 material can be positioned on and attached to a non-woven material 602 or equivalent thereof. The non-woven material 602 with the peg 600 material can be positioned below the gelastic material and/or attached to the bottom surface 90 of the gelastic material. One example in which the non-woven can be attached to the gelastic cushion is by ironing (heating) the non-woven material to the gelastic material.

Another embodiment of the present invention occurs when different sized and/or shaped pegs are positioned below certain locations of the gelastic material in order to strengthen some areas and not others. This embodiment is a variation of the embodiments illustrated in FIGS. 32 and 33 but with more pegs of different shapes and/or sizes for different areas of the gelastic material.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

We claim:

1. A gelastic cushion comprising

A. a first set of buckling walls (i) made of a first gelastic material having a first triblock polymer of the general configuration A-B-A and a first plasticizer;

(ii) define a first top and bottom open-ended opening area wherein there is no gelastic skin material positioned on or across the first set of buckling walls' top surface and bottom surface, (iii) are the tallest walls in the gelastic cushion with a first height ranging from the first set of buckling walls' bottom surface to the first set of buckling walls' top surface, (iv) have a first width that allows the first set of buckling walls to buckle, when a force is applied at the first set of buckling walls' top surface to the first set of buckling walls, into the first opening area or into (a) an adjacent second opening and/or (b) exterior to the perimeter of the gelastic cushion;

B. a second buckling wall (i) made of a second gelastic material having a second triblock polymer of the general configuration A-B-A and a second plasticizer;

(ii) positioned within the first opening area, (iii) interconnects to (a) a first wall of the first set of buckling walls at a first interconnection area that extends from the first set of buckling walls' bottom surface a distance greater than zero along the first wall toward the first set of buckling walls' top surface and (b) a second wall of the first set of buckling walls at a second interconnection area that extends from the first set of buckling walls' bottom surface a distance greater than zero along the second wall toward the first set of buckling walls' top surface wherein the first interconnection area is diametrical to the second interconnection area;

(iv) has a second height, which is less than the first height of the first set of buckling walls and the difference between the first height of the first set of buckling walls and the second height of the second buckling wall is a first differential distance; and (v) has a second width that allows the second buckling wall to buckle into the first opening area if the force applied to the first set of buckling walls buckles the first set of buckling walls a distance greater than the first differential distance.

2. The gelastic cushion of claim 1 wherein the first width and the second width are the same width.

3. The gelastic cushion of claim 1 wherein the first width and the second width are different widths.

4. The gelastic cushion of claim 1 wherein the second wall has a top surface having a concave shape between the first interconnection area and the second interconnection area.

5. The gelastic cushion of claim 1 wherein the second wall has a top surface having a convex shape between the first interconnection area and the second interconnection area.

6. The gelastic cushion of claim 1 wherein the second buckling wall has a top surface having a planar shape between the first interconnection area and the second interconnection area.

7. The gelastic cushion of claim 1 further comprising a third buckling wall (i) made of a third gelastic material having a third triblock polymer of the general configuration A-B-A and a third plasticizer;

(ii) positioned within the first opening area, (iii) interconnects to (a) a third wall of the first set of buckling walls at a third interconnection area that extends from the first set of buckling walls' bottom surface a distance greater than zero along the third wall toward the first set of buckling walls' top surface and (b) a fourth wall of the first set of buckling walls at a fourth interconnection area that extends from the first set of buckling walls' bottom surface a distance greater than zero along the fourth wall toward the first set of buckling walls' top surface wherein the third interconnection area is diametrical to the fourth interconnection area and is not the first interconnection area or the second interconnection area;

(iv) has a third height, which is lower than the first height and the second height wherein the difference between the first height and the third height is a second differential distance and the difference between the second height and the third height is a third differential distance;

(v) a third width that allows the third buckling wall to buckle into the first opening area if the force applied to (a) the first set of buckling walls buckles the first set of buckling walls a distance greater than the second differential distance and (b) the second buckling wall buckles the second buckling wall a distance greater than the third differential distance.

8. The gelastic cushion of claim 7 wherein the first width, the second width, and the third width are the same width, different widths or combinations thereof.

9. The gelastic cushion of claim 7 wherein the second buckling wall has a top surface having a shape selected from the group consisting of convex, concave, planar, and combinations thereof; and the third buckling wall has a top surface having a shape selected from the group consisting of convex, concave, planar, and combinations thereof.

10. The gelastic cushion of claim 1 wherein the gelastic structure is incorporated into a portion of a mattress design.

11. The gelastic cushion of claim 1 wherein the first gelastic material and the second gelastic material can be the same or different materials.

12. The gelastic cushion of claim 7 wherein the first gelastic material, the second gelastic material, and the third gelastic material can be the same materials, different materials or combinations thereof.

13. The gelastic cushion of claim 1 wherein the second buckling wall has a protrusion and the protrusion interconnects to the first wall of the first set of buckling walls at the first interconnection area.

14. The gelastic cushion of claim 1 wherein the second buckling wall and the first set of buckling walls are formed in the same mold with the same gelastic material so the second buckling wall interconnects to the first wall of the first set of buckling walls at the first interconnection area.

15. The gelastic cushion of claim 7 wherein the second buckling wall has a gap to receive a portion of the third buckling wall.

16. The gelastic cushion of claim 15 wherein the third interconnection area receives a portion of the third buckling wall.

17. The gelastic cushion of claim 1 further comprising a peg positioned below the second buckling wall.

18. The gelastic cushion of claim 1 further comprising a peg positioned below the gelastic cushion and attached to a non-woven.

* * * * *